US008678142B2

(12) United States Patent
Takeuchi

(10) Patent No.: US 8,678,142 B2
(45) Date of Patent: Mar. 25, 2014

(54) DESTINATION FLOOR REGISTRATION DEVICE OF ELEVATOR, HAVING VOICE INPUT

(75) Inventor: Nobukazu Takeuchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 400 days.

(21) Appl. No.: 13/119,726

(22) PCT Filed: Oct. 3, 2008

(86) PCT No.: PCT/JP2008/068014

§ 371 (c)(1),
(2), (4) Date: Mar. 18, 2011

(87) PCT Pub. No.: WO2010/038304

PCT Pub. Date: Apr. 8, 2010

(65) Prior Publication Data

US 2011/0168499 A1 Jul. 14, 2011

(51) Int. Cl.
*B66B 1/34* (2006.01)

(52) U.S. Cl.
USPC ..... 187/392; 187/247

(58) Field of Classification Search
USPC ..... 187/247, 380–389, 391–393, 396, 399
See application file for complete search history.

(56) References Cited

U.S. PATENT DOCUMENTS 4,590,604 A * 5/1986 Feilchenfeld ..... 704/272
4,691,808 A * 9/1987 Nowak et al. ..... 187/385
5,258,586 A * 11/1993 Suzuki et al. ..... 187/392
5,952,626 A * 9/1999 Zaharia ..... 187/381
6,223,160 B1 * 4/2001 Kostka et al. ..... 704/275
6,397,976 B1 * 6/2002 Hale et al. ..... 187/392
6,828,918 B2 * 12/2004 Bowman et al. ..... 340/4.1
6,902,041 B2 * 6/2005 Eccleston ..... 187/380
6,986,408 B2 * 1/2006 Takeuchi ..... 187/380
7,711,565 B1 * 5/2010 Gazdzinski ..... 704/270
7,936,249 B2 * 5/2011 Friedli ..... 340/5.5
8,061,485 B2 * 11/2011 Finschi ..... 187/384
8,439,169 B2 * 5/2013 Iio et al. ..... 187/387

FOREIGN PATENT DOCUMENTS

CN 101061050 A 10/2007
EP 971330 A1 * 1/2000
JP 57 48577 3/1982
JP 1 247378 10/1989

(Continued)

OTHER PUBLICATIONS

Korean Office Action issued on Dec. 27, 2012, in patent Application No. 10-2011-7005660 with English translation.

(Continued)

*Primary Examiner* — Anthony Salata
(74) *Attorney, Agent, or Firm* — Oblon, Spivak, McClelland, Maier & Neustadt, L.L.P.

(57) ABSTRACT

In a destination floor registration device 800, a boarding detection unit 804 detects a boarding of an elevator user; when no button operation by destination floor registration buttons 500 is performed after a predetermined period of time has elapsed since detection of the boarding, a voice destination floor registration unit 805 outputs from a voice output device 400 a message for prompting a passenger to pronounce a destination floor; a voice recognition unit 806 recognizes the destination floor pronounced by the passenger; and a voice destination floor registration unit 805 requests an elevator car control device 200 to register the destination floor recognized by the voice recognition unit 806.

7 Claims, 5 Drawing Sheets

(56) References Cited

FOREIGN PATENT DOCUMENTS

| | | | | |
|---|---|---|---|---|
| JP | 3 98967 | | | 4/1991 |
| JP | 04129976 | A | * | 4/1992 |
| JP | 6 72648 | | | 3/1994 |
| JP | 6-72648 | | | 3/1994 |
| JP | 2000 118895 | | | 4/2000 |
| JP | 2006 36472 | | | 2/2006 |
| JP | 2006-36472 | | | 2/2006 |
| JP | 2006 327739 | | | 12/2006 |
| JP | 2006-327739 | A | | 12/2006 |
| JP | 2007 223733 | | | 9/2007 |
| JP | 2008 273689 | | | 11/2008 |

OTHER PUBLICATIONS

Chinese Office Action Issued Oct. 9, 2012 in Patent Application No. 200880131375.4 (with English translation).
Korean Office Action issued Jun. 28, 2012, in Patent Application No. 10-2011-7005660 (with English-language translation of relevant portions).
Japanese Office Action Issued Jan. 22, 2013 in Patent Application No. 2010-531691 (with English translation).
International Search Report issued Apr. 28, 2009 in PCT/JP08/68014 filed Oct. 3, 2008.
Korean Office Action issued Jan. 2, 2014 in Patent Application No. 10-2011-7005660 (with English translation).

* cited by examiner

DESTINATION FLOOR REGISTRATION DEVICE OF ELEVATOR, HAVING VOICE INPUT

TECHNICAL FIELD

This invention relates to a destination floor registration device of an elevator car.

BACKGROUND ART

For example, Patent Literature 1 and Patent Literature 2 disclose techniques in which a call registration device located at an elevator hall activates a voice recognition function by detecting the presence of an elevator user, and registers an elevator car call when a registered voice of the elevator user is recognized.

Patent Literature 1: JP 1-247378 A

Patent Literature 2: JP 3-98967 A

DISCLOSURE OF INVENTION

Technical Problem

The techniques described in Patent Literature 1 and Patent Literature 2 have a problem. The problem is that when a person enters a detection range, the voice recognition function is activated, so that voice recognition is performed on a voice for a purpose other than call registration.

There is another problem that voice recognition is not performed successfully when a plurality of persons pronounce simultaneously.

There is still another problem that the voice recognition function reacts to even an elevator user not requiring voice-operated call registration.

Besides, for example, even when an elevator user not requiring voice-operated registration call is in a hurry, the user is required to wait for the voice recognition function to be activated, pronounce, and then wait for voice recognition to complete.

Some users may have an aversion to being obliged to input voice unnecessarily.

Then, when the techniques of Patent Literature 1 and Patent Literature 2 are applied to destination floor registration in an elevator car, the above problems still remain.

One of the main objects of this invention is to solve the above-described problems. This invention mainly aims to realize a destination floor registration device that performs voice-operated destination floor registration only in a situation where voice-operated destination floor registration is required.

Solution to Problem

A destination floor registration device of an elevator according to this invention includes:

a destination floor registration signal input unit that inputs a destination floor registration signal from a destination floor registration button placed in an elevator car;

a boarding detection unit that detects that a passenger has boarded the elevator car;

a voice output unit that outputs a voice message to the elevator car;

a voice input unit that inputs a voice message from the elevator car; and a voice destination floor registration unit that, when the destination floor registration signal input unit does not input the destination floor registration signal after a predetermined time limit has elapsed since the passenger was detected to board the elevator car by the boarding detection unit, outputs a destination floor pronouncing request voice message to the elevator car via the voice output unit for requesting the passenger to pronounce a destination floor, and, when a voice message responding to the voice destination floor pronouncing request voice message is input via the voice input unit, performs a voice recognition process on the voice message input and performs destination floor registration for the elevator car based on a result of the voice recognition process.

The boarding detection unit determines whether or not a passenger who has newly boarded the elevator car is alone in the elevator car; and the voice destination floor registration unit, when the boarding detection unit has determined that the passenger who has newly boarded the elevator car is alone in the elevator car, outputs the destination floor pronouncing request voice message to the elevator car via the voice output unit.

The boarding detection unit determines whether or not the passenger who has newly boarded the elevator car is alone in the elevator car, based on a sensing result of a sensor placed in a vicinity of a door of the elevator car.

The boarding detection unit determines whether or not the passenger who has newly boarded the elevator car is alone in the elevator car, based on a weighing result of a scale for weighing a weight of the elevator car.

The voice destination floor registration unit determines whether or not the destination floor recognized as a result of the voice recognition process exists in a direction of travel of the elevator car, and, when the destination floor recognized exists in the direction of travel of the elevator car, performs destination floor registration with the destination floor, and, when the destination floor recognized does not exist in the direction of travel of the elevator car, outputs a voice message to the elevator car via the voice output unit for requesting for pronouncing a destination floor again.

The destination floor registration device of the elevator further includes a voice destination floor registration request information input unit that inputs voice destination floor registration request information for notifying that the passenger of the elevator car requests voice-operated destination floor registration, and the voice destination floor registration unit, when the voice destination floor registration request information input unit has input the voice destination floor registration request information, outputs the destination floor pronouncing request voice message to the elevator car via the voice output unit, regardless of whether or not the destination floor registration signal has been input, and, when the voice destination floor registration request information input unit has not input the voice destination floor registration request information, and when the destination floor registration signal input unit does not input the destination floor registration signal after the predetermined time limit has elapsed since the passenger was detected to board the elevator car by the boarding detection unit, outputs the destination floor pronouncing request voice message to the elevator car via the voice output unit.

The voice destination floor registration unit, upon arrival at a floor for which destination floor registration has been performed based on the voice recognition process, outputs a voice message to the elevator car via the voice output unit for notifying the arrival at the destination floor.

Advantageous Effects of Invention

According to this invention, voice-operated destination floor registration is performed only when no signal from a destination floor registration button is input after a predetermined time limit has elapsed since a passenger was detected to board an elevator car. Thus, destination floor registration by voice recognition can be implemented only in a situation where it is difficult to operate a destination floor registration button and voice-operated destination floor registration is required.

DESCRIPTION OF PREFERRED EMBODIMENTS

Embodiment 1

FIG. 1 shows an example overall configuration of an elevator system including a destination floor registration device 800 according to this embodiment.

At least one destination floor registration device 800 is installed in an elevator car 100. The destination floor registration device 800 is connected with an elevator car control device 200 through a communication channel.

When an elevator user boards the elevator car and then no button operation by a destination floor registration button is performed after a predetermined period of time has elapsed since the boarding, the destination floor registration device 800 prompts a passenger to pronounce a destination floor, recognizes the destination floor pronounced by the passenger, and requests the elevator car control device 200, via the communication channel, to register the recognized destination floor.

Destination floor registration by voice recognition is performed when it is difficult to register a destination floor by operating a destination floor registration button, such as, for example, when a physically disabled person with impaired vision, quadriplegia, or the like boards the elevator car 100, or when an able-bodied person has both hands occupied.

The elevator car control device 200 registers a destination floor requested by the destination floor registration device 800 and has the elevator car 100 travel.

The destination floor registration device 800 is connected with a voice input device 300, a voice output device 400, destination floor registration buttons 500, a sensor 600, and a scale 700.

The voice input device 300 is a device that inputs voice in the elevator car 100, and is, for example, a microphone.

The voice output device 400 is a device that outputs a voice message or an operation tone in the elevator car 100, and is, for example, a speaker.

The destination floor registration buttons 500 are buttons for an elevator user to register a destination floor without using voice recognition.

The sensor 600 senses that an elevator user has entered the elevator car 100. For example, as shown in FIG. 2, a pair of sensors 600 may be placed in a depth direction at both sides of a door of the elevator car 100, so that the entrance into the elevator car and the exit from the elevator car can be distinguished. Note that the position and the number of the sensors 600, etc. are not limited to the example of FIG. 2.

The scale 700 measures the weight of the elevator car 100.

The destination floor registration device 800 may, for example, be incorporated in a control panel located at an inner side of a wing wall on which the voice input device 300, the voice output device 400, the destination floor registration buttons 500, etc. are located, as illustrated in FIG. 2.

The destination floor registration device 800 may be configured with a microcomputer, a memory, and so on.

It is also possible that the memory may be incorporated into the microcomputer.

Further, a part of the functionality of the destination floor registration device 800, such as a voice destination floor registration unit 805, a voice input unit 801, and a voice output unit 802, may be incorporated into the microcomputer. This makes it possible to configure the destination floor registration device 800 with more commonly available parts, so that cost can be reduced.

As a hardware configuration of the destination floor registration device 800, a CPU (Central Processing Unit), a ROM (Read Only Memory), a RAM (Random Access Memory), a magnetic disk device, a communication board, and so on may be connected with a bus. In this case, programs for realizing the functions (" . . . units") presented as internal elements of the destination floor registration device 800 may be stored, for example, in a magnetic disk device, and the CPU executes each function by reading these programs as appropriate.

Next, an example internal configuration of the destination floor registration device 800 will be described.

The voice input unit 801 is connected with the voice input device 300, and inputs a voice message from the voice input device 300.

The voice output unit 802 is connected with the voice output device 400, and outputs a voice message from the voice output device 400.

A destination floor registration signal input unit 803 is connected with the destination floor registration buttons 500, and inputs a destination floor registration signal (also called a button signal) from the destination floor registration buttons 500.

A boarding detection unit 804 is connected with the sensors 600 and the scale 700, and inputs signals from the sensors 600 and the scale 700 to detect that a passenger (an elevator user) has boarded the elevator car 100.

Specifically, for example, the boarding detection unit 804 inputs sensed signals from the sensors 600. When the sequence of sensing is such that sensing by the sensor at the elevator hall side is followed by sensing by the sensor at the interior side of the elevator car, the boarding detection unit 804 determines that a passenger has boarded. Alternatively, the boarding detection unit 804 determines that a passenger has boarded when the weight of the elevator car 100 increases while the elevator car stays at a landing floor.

Note that passenger detection methods are not limited to these. For example, a camera may be installed inside the elevator car 100 for shooting the vicinity of the door of the elevator car 100, and the boarding detection unit 804 may detect the boarding of a passenger by analyzing images shot by this camera.

Alternatively, the boarding detection unit 804 may combine these methods to detect the boarding of a passenger.

The voice destination floor registration unit 805 includes a voice recognition unit 806, and performs voice-operated destination floor registration. The voice destination floor registration unit 805 has stored therein a destination floor pronouncing request voice message for requesting a passenger to pronounce a destination floor, and by outputting the destination floor pronouncing request voice message from the voice output device 400, prompts a passenger to register a destination floor by voice.

More specifically, when the destination floor registration signal input unit 803 does not input any destination floor registration signal after a predetermined time limit has elapsed since the boarding detection unit 804 detected a passenger boarding the elevator car 100, the voice destination floor registration unit 805 has the voice output device 400 output the destination floor pronouncing request voice message via the voice output unit 802. The time limit is preferably an average period of time required for a passenger to press one of the destination floor registration buttons 500 after boarding the elevator car 100, and is set in a range of 5 to 10 seconds, for example.

Then, when a voice message in response to the destination floor pronouncing request voice message (a voice message in which a destination floor is pronounced by the passenger) is input via the voice input device 300 and the voice input unit 801, the voice destination floor registration unit 805 has the voice recognition unit 806 perform a voice recognition process on the input voice message, and registers a destination floor for the elevator car 100 based on the result of the voice recognition process.

In a situation where a newly boarding passenger has difficulty in operating the destination floor registration buttons 500, such as when a physically disabled person boards the elevator car or when an able-bodied person has both hands occupied, it is generally considered that no destination floor registration signal is input from the destination floor registration buttons 500 even after a certain period of time has elapsed since detection of the boarding of a new passenger by the boarding detection unit 804.

On the other hand, even when the newly boarding passenger is a physically disabled person, an able-bodied person with both hands occupied, or the like, if there is another passenger at the destination floor registration device 800, the newly boarding passenger, who has difficulty in operating the destination floor registration buttons 500 by himself/herself, can ask the other passenger to operate the destination floor registration buttons 500. In such a case, it is considered that the other passenger can operate the destination floor registration buttons 500 relatively early after detection of the boarding of a passenger by the boarding detection unit 804.

From this standpoint, when no destination floor registration signal is input from the destination floor registration buttons 500 after a predetermined time limit has elapsed since detection of the boarding of a passenger by the boarding detection unit 804, the voice destination floor registration unit 805 outputs a destination floor pronouncing request message to request the passenger to pronounce a destination floor, based on an assumption that the passenger has difficulty operating the destination floor registration buttons 500 and has no other passenger to ask to operate the destination floor registration buttons 500 (for example, boarding alone with no other passenger at the destination floor registration device 800).

The destination floor pronouncing request message is, for example, a voice message "Please pronounce your destination floor."

In addition to the destination floor pronouncing request voice message, the voice destination floor registration unit 805 also stores therein voice messages of a plurality of types and can select and output an appropriate voice message according to the situation.

When the destination floor registration signal input unit 803 inputs a destination floor registration signal, a button destination floor registration unit 807 requests the elevator car control device 200 to register the destination floor specified by the destination floor registration signal.

A control unit 808 exercises overall control of the destination floor registration device 800.

A timer 809 measures a period of time from detection of the boarding of a passenger by the boarding detection unit 804.

Next, example operations of the destination floor registration device 800 according to this embodiment will be described with reference to the flowchart in FIG. 3.

When the elevator car 100 arrives at one of the floors, the destination floor registration device 800 waits for a passenger to board.

Then, the boarding detection unit 804 determines whether or not a new passenger has boarded at that floor (S301). If the boarding detection unit 804 has detected that a new passenger has boarded the elevator car 100 at that floor (YES at S301), the control unit 808 determines whether or not the destination floor registration signal input unit 803 has input a button signal (a destination floor registration signal) from the destination floor registration buttons 500 (S302).

As described above, the boarding detection unit 804 determines the boarding of a passenger when the sensors 600 sense a person moving from the elevator hall toward the elevator car 100, or when the weight of the elevator car 100 measured by the scale 700 increases.

If the destination floor registration signal input unit 803 has input a button signal from the destination floor registration buttons 500 (YES at S302), the control unit 808 activates the button destination floor registration unit 807, and the button destination floor registration unit 807 registers the destination floor specified by the button signal (S313). That is, the button destination floor registration unit 807 notifies the destination floor to the elevator car control device 200 via the communication channel. Then, the elevator car control device 200 has the elevator car travel based on the notified destination floor, and notifies the destination floor registration device 800 that registration has been done.

On the other hand, if the destination floor registration signal input unit 803 has not input a button signal from the destination floor registration buttons 500 (NO at S302), the control unit 808 determines whether or not a predetermined time limit has elapsed since detection of the boarding of the passenger (S303). If the time limit has not elapsed (NO at S303), the control unit 808 continues to wait for an input of a button signal (S302). If the time limit has elapsed (YES at S303), the control unit 808 activates the voice destination floor registration unit 805.

If no button signal is input after the time limit has elapsed and the voice destination floor registration unit 805 is activated, the voice destination floor registration unit 805 reads out a destination floor pronouncing request voice message stored therein and outputs the destination floor pronouncing request voice message from the voice output device 400 via the voice output unit 802 to request the passenger to register a destination floor by voice (S304). In this case, the voice destination floor registration unit 805 reads out, as a destination floor pronouncing request voice message, a message "Please pronounce your destination floor" or a response tone "beep" and outputs the voice message from the voice output device 400 to notify the user of how to proceed or that the destination floor registration device 800 has responded, thereby enhancing its user-friendliness.

Next, the voice destination floor registration unit 805 waits for an input from the voice input device 300. If voice is input via the voice input unit 801 (YES at S305), the voice recognition unit 806 recognizes a destination floor pronounced by the passenger by the voice recognition process (S306). For example, when "fourth floor" is input, the voice recognition unit 806 recognizes "fourth floor".

On the other hand, if no voice is input when waiting for an input (NO at S305) and a predetermined waiting time has elapsed (YES at S312), the destination floor registration device 800 terminates the processing.

If the voice recognition unit 806 recognizes a destination floor by performing voice recognition, the voice destination floor registration unit 805 determines whether or not the destination floor recognized by the voice recognition unit 806 exists in the building in which the destination floor registration device 800 is installed (S307).

If the destination floor does not exist (NO at S307), the voice destination floor registration unit 805 outputs a destination floor pronouncing request voice message again from the voice output device 400 via the voice output unit 802, to request the passenger to register a destination floor by voice (S304). In this case, the same voice message as the initial output may be output, or alternatively, for example, "Please pronounce your destination floor again" or a response tone "beep, beep" may be output.

If the destination floor exists (YES at S307), the voice destination floor registration unit 805 determines whether or not the floor recognized by the voice recognition unit 806 is in line with the direction of the call registration button operated at the elevator hall, that is, the direction of travel (up, down) of the elevator car 100 (S308).

If the destination floor recognized by the voice recognition unit 806 is not in line with the direction of travel of the elevator car 100 (NO at S307), the voice destination floor registration unit 805 outputs a destination floor pronouncing request voice message again from the voice output device 400 via the voice output unit 802, to request the passenger to register a destination floor by voice (S304). Also in this case, the same voice message as the initial output may be output, or alternatively, for example, "Please pronounce your destination floor again" or a response tone "beep, beep" may be output.

If the destination floor recognized by the voice recognition unit 806 is in line with the direction of travel of the elevator car 100 (YES at S307), the voice destination floor registration unit 805 determines whether or not the destination floor recognized by the voice recognition unit 806 has already been registered as a destination floor (S309), and if not yet registered as a destination floor (NO at S309), the voice destination floor registration unit 805 registers the floor recognized by the voice recognition unit 806 as a destination floor (S310). That is, the voice destination floor registration unit 805 notifies the destination floor (the fourth floor in this case) to the elevator car control device 200 via the communication channel. Then, the elevator car control device 200 has the elevator car travel based on the notified destination floor, and notifies the destination floor registration device 800 that registration has been done.

On the other hand, if the recognized destination floor has already been registered as a destination floor (YES at S309), the processing proceeds to S311.

Lastly, the voice destination floor registration unit 805 vocally announces to the passenger that the floor input by voice has been registered as the destination floor (S311).

More specifically, the voice destination floor registration unit 805 reads out a stored voice message, for example, "Fourth floor has been registered" or a response tone "beep", and outputs the voice message from the voice output device 400 via the voice output unit 802, thereby enhancing its user-friendliness.

"Fourth" and "floor has been registered" out of the above voice message "Fourth floor has been registered" may be separately stored and these parts may be combined when being output.

In the S307 above, the destination floor registration device 800 decides whether or not the destination floor exists, but the elevator car control device 200 may be configured to make this decision instead of the destination floor registration device 800.

Similarly, in S308, the destination floor registration device 800 decides whether or not the destination floor is in line with the direction of travel of the elevator car 100, but the elevator car control device 200 may be configured to make this decision instead of the destination floor registration device 800.

Similarly, in S309, the destination floor registration device 800 decides whether or not the recognized destination floor has already been registered, but the elevator car control device 200 may be configured to make this decision instead of the destination floor registration device 800.

Besides, when the elevator car 100 arrives at a floor registered as a destination floor based on the voice recognition process, the voice destination floor registration unit 805 may be configured to output a voice message for notifying the arrival at the destination floor from the voice output device 400 via the voice output unit 802.

In this way, according to this embodiment, destination floor registration by voice recognition is performed only when destination floor registration by voice recognition is required. Thus, it is possible to prevent voice recognition on a voice for a purpose different from destination floor registration.

Besides, whether or not to perform voice recognition is determined after a certain period of time (for example, 5 seconds) has passed since detection of the boarding of a passenger, so that a destination floor pronouncing request voice message will not be output if a new passenger can operate the destination floor registration buttons or if a new passenger can ask another passenger to operate the destination floor registration buttons. That is, destination floor registration by voice recognition is performed only when a passenger has difficulty operating the destination floor registration buttons and also has no other passenger to ask to operate the destination floor registration buttons (for example, boarding alone). Thus, it is possible to avoid a voice recognition failure caused by a plurality of people's simultaneous voices. Besides, no voice recognition is made with reacting to a user who does not need voice recognition.

In this way, according to this embodiment, the recognition rate of voice recognition can be improved.

As has been described, it is difficult for a person with impaired vision, quadriplegia, or the like to board an elevator alone and register a destination floor by operating a destination floor registration button in an elevator car. The destination floor registration device 800 according to this embodiment prompts a passenger to pronounce a destination floor, recognizes the destination floor by voice recognition, and registers the destination floor when a state without any destination floor registration button being operated lasts for a certain period of time after detection of the boarding of a user. Thus, a person with impaired vision, quadriplegia, or the like, even when boarding alone, can feel safe in using the elevator.

Further, the destination floor registration device 800 according to this embodiment reads out stored voice information such as, for example, "Fourth floor has been registered" or a response tone "beep", and outputs the voice information from the voice output device.

The voice information is output by combining a plurality of separate phrases, such as "fourth" and "floor has been registered", to allow repeated use of the same phrases. In this way, the amount of stored voice information is reduced, thereby leading to cost savings.

Furthermore, when no voice input is made after a certain period of time has elapsed since a destination floor pronouncing request voice message was output, the voice recognition function becomes invalid and a state waiting for a destination floor registration button is set. This improves user-friendliness without compromising user-friendliness for those not requiring destination floor registration by voice recognition.

In this embodiment, it has been described that the destination floor registration device of an elevator to be installed in an elevator car includes the voice input unit that inputs voice, the voice recognition unit that recognizes a destination floor from the voice input to the voice input unit, and the voice destination floor registration unit that controls a destination floor of the elevator based on the destination floor recognized by the voice recognition unit. It has also been described that when the boarding detection unit detects the boarding of a user, the voice recognition unit recognizes the voice of the user input from the voice input unit, and the voice destination floor registration unit notifies the destination floor recognized by the voice recognition unit to the elevator car control device.

In this embodiment, it has also been described that the destination floor registration device is provided with the voice output unit, and by outputting voice guidance from the voice output unit in response to a boarding detection, a registered call, or the like, user operability can be improved.

In this embodiment, it has also been described that when a certain period of time (for example, 5 seconds) has elapsed without any car destination floor button being registered after the boarding detection unit detected the boarding of a passenger, it is determined that destination floor registration by voice recognition is required. This makes it possible, when passengers get on and off intermittently, to accurately identify a situation where destination floor registration by voice recognition is required.

Embodiment 2

In the destination floor registration device of the first embodiment, when no destination floor registration signal is input after a time limit has elapsed since detection of the boarding of a passenger, it is determined that voice-operated destination floor registration is required and a destination floor pronouncing request message is output.

However, for example, when the destination floor of a new passenger has already been registered, the destination floor registration buttons 500 will not be operated, so that no destination floor registration signal will be input. Even in this case, however, a destination floor pronouncing request voice message will be output according to the method of the first embodiment.

On the other hand, when there is one passenger in the elevator car, that is, when a newly boarding passenger is the sole passenger in the elevator car, it is often the case that no destination floor has been registered yet, so that the newly boarding passenger registers a destination floor.

In this embodiment, an example will be described in which a destination floor pronouncing request message is output only when a new passenger is alone in the elevator car.

An example configuration of the elevator car 100 and the elevator car control device 200 according to this embodiment is as illustrated in FIG. 1.

In this embodiment, however, the boarding detection unit 804 detects whether a new passenger is alone in the elevator car. Specifically, for example, the boarding detection unit 804 inputs sensed signals from the sensors 600, and by counting the sensed signals, detects the number of passengers getting on and the number of passengers getting off. Based on the number of passengers getting on and the number of passengers getting off, the boarding detection unit 804 detects whether a new passenger is alone in the elevator car 100 at present.

As explained in the first embodiment, the sensors 600 are installed, for example, at both sides of the door and detect a user passing through the door.

Together with the sensing results of the sensors 600, the boarding detection unit 804 also uses the weight of the elevator car 100 measured by the scale 700 to detect whether a newly boarding passenger is alone in the elevator car 100. For example, the boarding detection unit 804 has stored therein an average weight (reference weight) of the elevator car 100 when there is one passenger. If the weight measured by the scale 700 matches the stored reference weight within a predetermined margin of error, the boarding detection unit 804 determines that there is one passenger.

As another method, for example, a camera may be installed for shooting the interior of the elevator car 100. By analyzing images shot by this camera, the boarding detection unit 804 may detect that a newly boarding passenger is alone in the elevator car 100.

Alternatively, a sensor, a scale and a camera may be employed in combination to detect that a new passenger is alone.

Example operations of the destination floor registration device 800 according to this embodiment are as illustrated in FIG. 4.

When the elevator car 100 arrives at one of the floors, the boarding detection unit 804 detects, as with the first embodiment, whether or not a new passenger has boarded at that floor (S301), counts the number of passengers in the elevator car 100, and determines whether or not a new passenger is alone in the elevator car.

Then, if the boarding detection unit 804 detects that a new passenger has boarded the elevator car 100 at that floor (YES at S301), the control unit 808 determines, as with the first embodiment, whether or not the destination floor registration signal input unit 803 has input a button signal (a destination floor registration signal) from the destination floor registration buttons 500 (S302).

If the destination floor registration signal input unit 803 has input a button signal from the destination floor registration buttons 500 (YES at S302), the control unit 808 activates the button destination floor registration unit 807, and the button destination floor registration unit 807 registers the floor specified by the button signal as a destination floor (S313).

On the other hand, if the destination floor registration signal input unit 803 has not input a button signal from the destination floor registration buttons 500 after a time limit has elapsed (NO at S302, YES at S303) and if the boarding detection unit 804 determined at S301 that the new passenger was alone in the elevator car (YES at S401), the control unit 808 proceeds to S304. The processings at S304 and thereafter are the same as those explained in the first embodiment, and thus the explanation is omitted.

Alternatively, if the new passenger is not alone (NO at S401), there are a plurality of persons in the elevator car 100, so that voice-operated destination floor registration is not required and the processing is terminated.

In this way, in this embodiment, destination floor registration by voice recognition is performed only when a new passenger is boarding alone, so that it is possible to preclude destination floor registration by voice recognition when it is not highly required.

In this embodiment, it has been described that the destination floor registration device of an elevator to be installed in an elevator car includes the voice input unit that inputs voice, the voice recognition unit that recognizes a destination floor from the voice input to the voice input unit, and the voice destination floor registration unit that controls a destination floor of the elevator based on the destination floor recognized by the voice recognition unit. It has also been described that when the boarding detection unit determines that a user is boarding alone, the voice recognition unit recognizes the voice of the user input from the voice input unit, and the voice destination floor registration unit notifies the destination floor recognized by the voice recognition unit to the elevator car control device.

In this embodiment, it has also been described that the boarding detection unit is connected to sensors installed, for example, at both sides of the door for detecting a user passing through the door, and, based on the sensing results of the sensors, the boarding detection unit counts the number of users who have boarded. The sensors make it possible to obtain the accurate number of persons passing through the door.

In this embodiment, it has also been described that the boarding detection unit is connected, for example, to a scale installed in the elevator car for measuring the weight of the elevator car, and, based on the measurement result of the scale, counts the number of users who have boarded. The scale makes it possible to obtain the accurate number of passengers.

Embodiment 3

In this embodiment, a destination floor registration device will be described wherein destination floor registration by voice recognition is performed when destination floor registration by voice recognition is requested by an elevator user, and when destination floor registration by voice recognition is not requested, destination floor registration is performed according to the procedure described in the first or second embodiment.

FIG. 5 shows an example configuration of the destination floor registration device 800 according to this embodiment.

In FIG. 5, in addition to the configuration of FIG. 1, a voice destination floor registration request information input unit 810 is provided.

The voice destination floor registration request information input unit 810 inputs voice destination floor registration request information for notifying that a passenger is requesting voice-operated destination floor registration.

In this embodiment, for example, a voice destination floor registration request button for requesting voice-operated destination floor registration is placed at each elevator hall. When a user wishing voice-operated destination floor registration, such as a physically disabled person, presses the voice destination floor registration request button, the voice destination floor registration request information input unit 810 inputs voice destination floor registration request information.

Alternatively, for example, a voice input device and a voice recognition processing device are placed at each elevator hall. A user wishing voice-operated destination floor registration, such as a physically disabled person, pronounces a predetermined message (for example, pronounces "voice registration"). Then, a voice recognition processing unit performs voice recognition on the message and outputs voice destination floor registration request information, and the voice destination floor registration request information input unit 810 inputs the voice destination floor registration request information.

Then, in this embodiment, if the voice destination floor registration request information input unit 810 has input voice destination floor registration request information, upon arrival of the elevator car 100 at the floor at which the voice destination floor registration request information has been generated, the voice destination floor registration unit 805 outputs a destination floor pronouncing request voice message from the voice output device 400, regardless of whether or not a button signal is input from the destination floor registration buttons 500. Thereafter, operations at S305 and thereafter in FIG. 3 or FIG. 4 are performed.

If the voice destination floor registration request information input unit 810 has not input voice destination floor registration request information, operations like those in the first and second embodiments are performed. That is, operations at S301 and thereafter in FIG. 3 or FIG. 4 are performed.

In this way, according to this embodiment, it is possible to ensure that voice-operated destination floor registration is provided for a passenger when the passenger wishes voice-operated destination floor registration.

Reference Signs List

Figure 1:
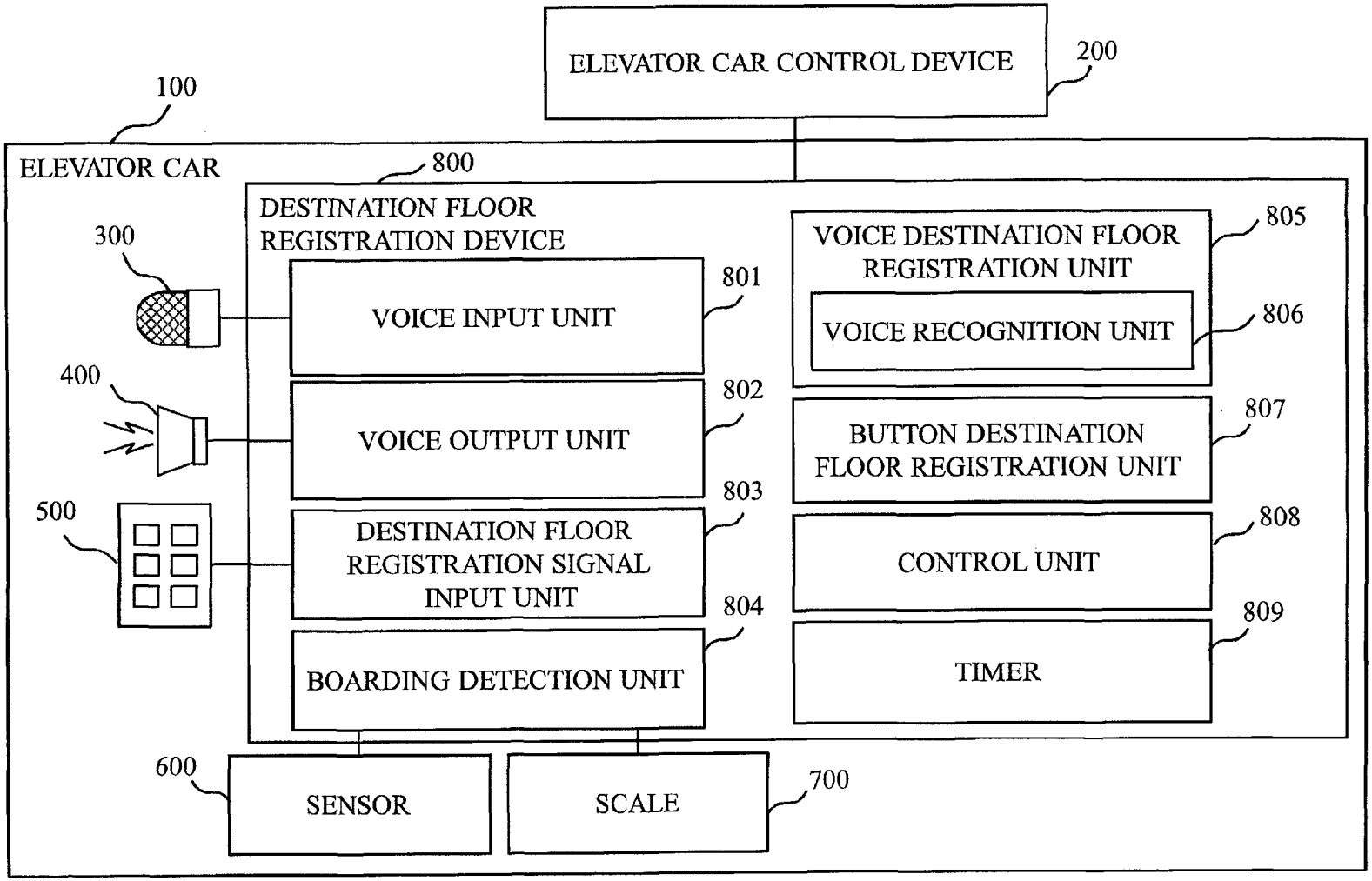
FIG. 1 is a diagram illustrating an example configuration of a destination floor registration device according to the first embodiment.
Figure 2:
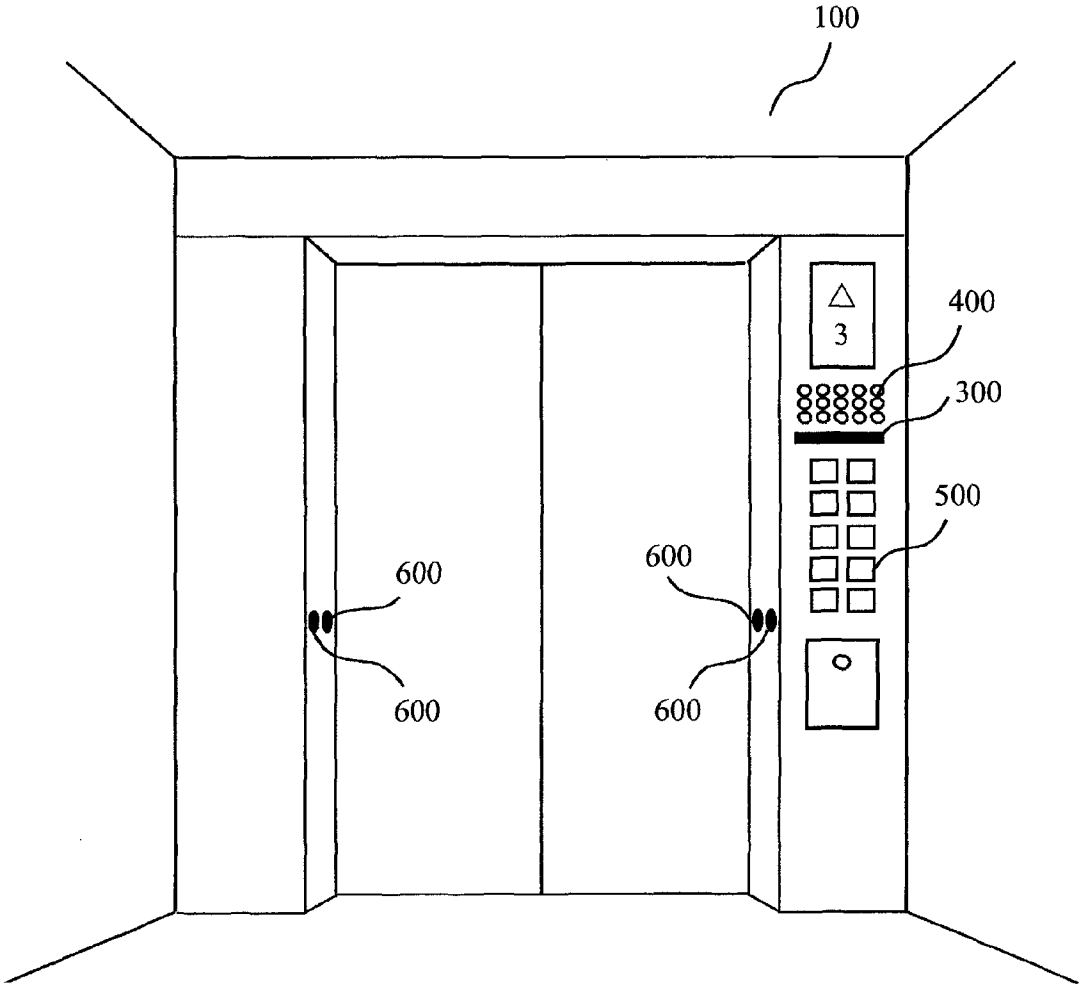
FIG. 2 is a diagram illustrating the interior of an elevator car according to the first embodiment.
Figure 3:
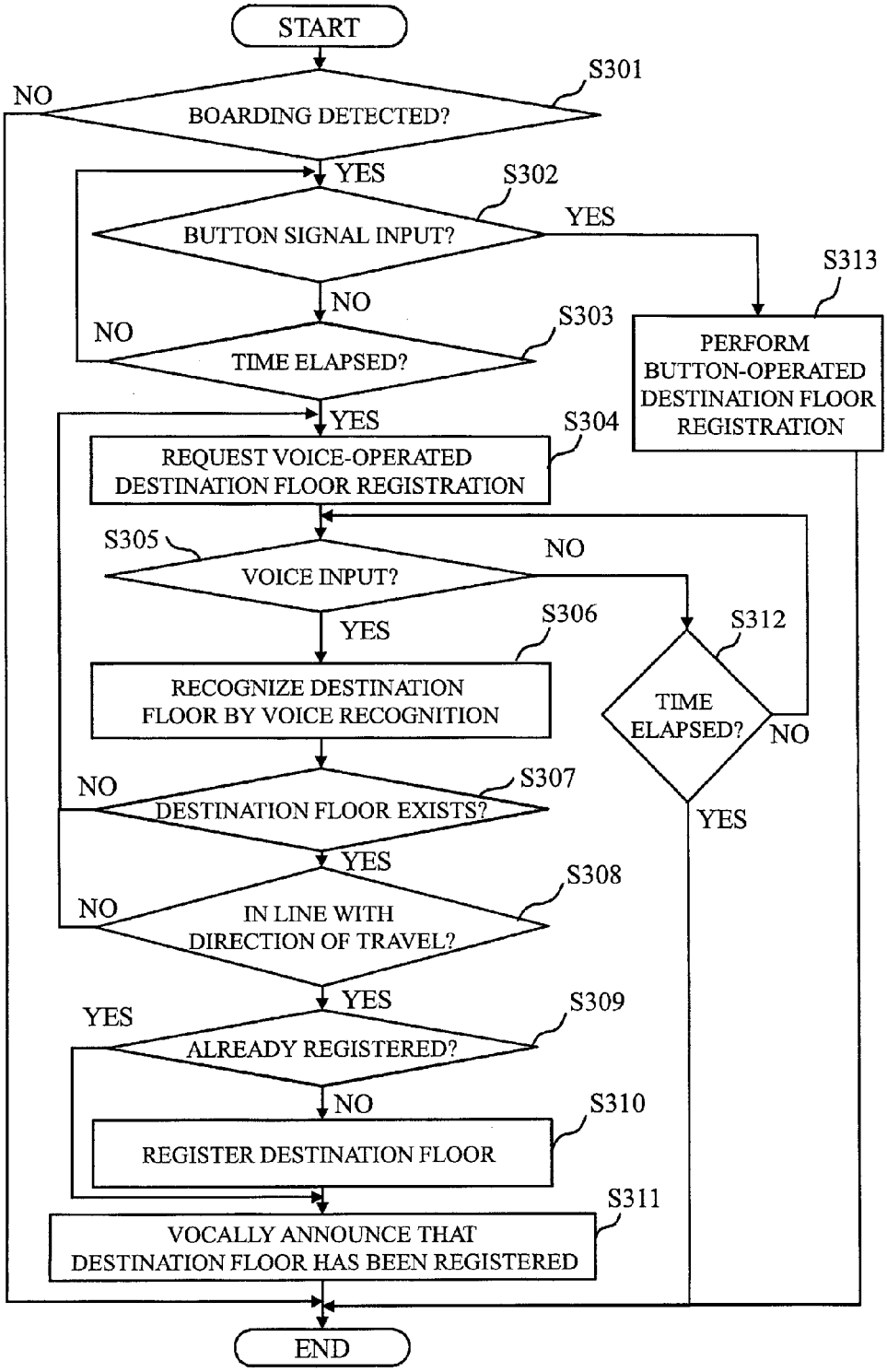
FIG. 3 is a flowchart diagram illustrating example operations of the destination floor registration device according to the first embodiment.
Figure 4:
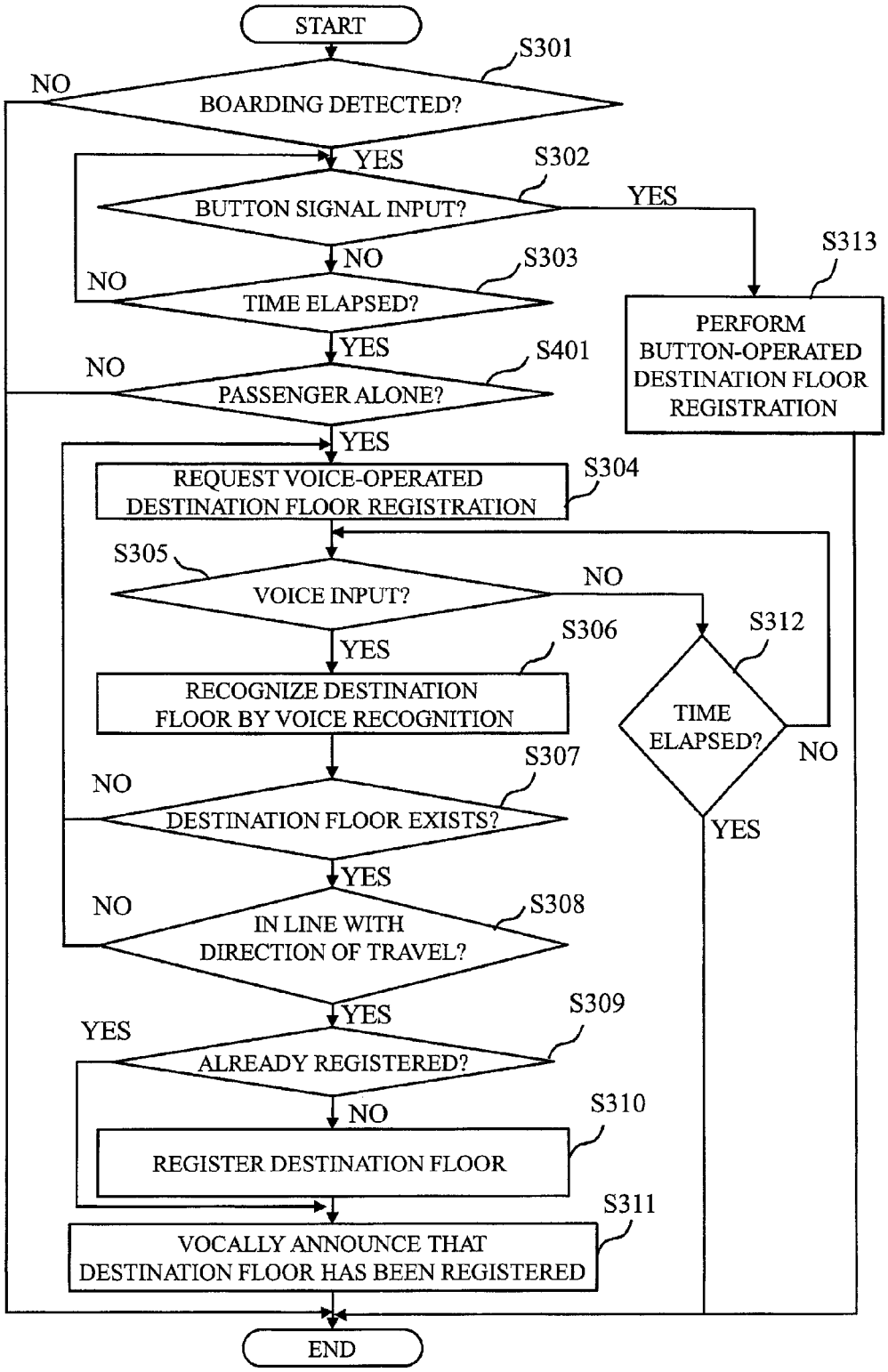
FIG. 4 is a flowchart diagram illustrating example operations of a destination floor registration device according to the second embodiment.
Figure 5:
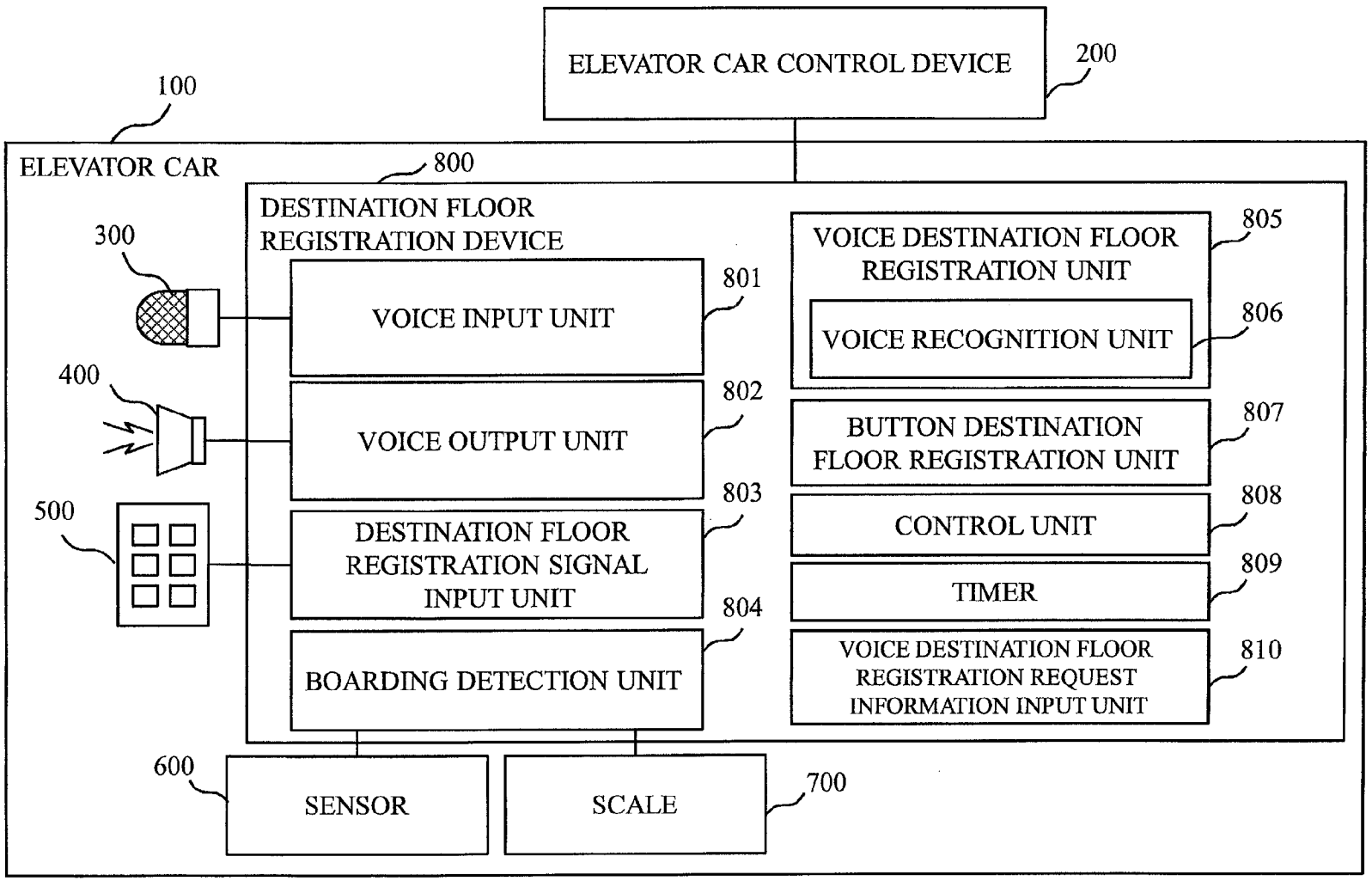
FIG. 5 is a diagram illustrating an example configuration of a destination floor registration device according to the third embodiment.

100: elevator car, 200: elevator car control device, 300: voice input device, 400: voice output device, 500: destination floor registration buttons, 600: sensor, 700: scale, 800: destination floor registration device, 801: voice input unit, 802: voice output unit, 803: destination floor registration signal input unit, 804: boarding detection unit, 805: voice destination floor registration unit, 806: voice recognition unit, 807: button destination floor registration unit, 808: control unit, 809: timer, 810: voice destination floor registration request information input unit

The invention claimed is:

1. A destination floor registration device of an elevator comprising:

a destination floor registration signal input unit that inputs a destination floor registration signal from a destination floor registration button placed in an elevator car;

a boarding detection unit that detects that a passenger has boarded the elevator car;

a voice output unit that outputs a voice message to the elevator car;

a voice input unit that inputs a voice message from the elevator car; and a voice destination floor registration unit that determines whether a predetermined time limit has elapsed since the passenger was detected to board the elevator car by the boarding detection unit and, when it is determined that the destination floor registration signal input unit has not inputted the destination floor registration signal after the predetermined time limit has elapsed since the passenger was detected to board the elevator car by the boarding detection unit, outputs a destination floor pronouncing request voice message to the elevator car via the voice output unit for requesting the passenger to pronounce a destination floor, and, when a voice message responding to the voice destination floor pronouncing request voice message is input via the voice input unit, performs a voice recognition process on the voice message input and performs destination floor registration for the elevator car based on a result of the voice recognition process.

2. The destination floor registration device of the elevator of claim 1, wherein:

the boarding detection unit determines whether or not a passenger who has newly boarded the elevator car is alone in the elevator car; and the voice destination floor registration unit, when the boarding detection unit has determined that the passenger who has newly boarded the elevator car is alone in the elevator car, outputs the destination floor pronouncing request voice message to the elevator car via the voice output unit.

3. The destination floor registration device of the elevator of claim 2, wherein the boarding detection unit determines whether or not the passenger who has newly boarded the elevator car is alone in the elevator car, based on a sensing result of a sensor placed in a vicinity of a door of the elevator car.

4. The destination floor registration device of the elevator of claim 2, wherein the boarding detection unit determines whether or not the passenger who has newly boarded the elevator car is alone in the elevator car, based on a weighing result of a scale for weighing a weight of the elevator car.

5. The destination floor registration device of the elevator of claim 1, wherein the voice destination floor registration unit determines whether or not the destination floor recognized as a result of the voice recognition process exists in a direction of travel of the elevator car, and, when the destination floor recognized exists in the direction of travel of the elevator car, performs destination floor registration with the destination floor, and, when the destination floor recognized does not exist in the direction of travel of the elevator car, outputs a voice message to the elevator car via the voice output unit for requesting for pronouncing a destination floor again.

6. The destination floor registration device of the elevator of claim 1, further including:

a voice destination floor registration request information input unit that inputs voice destination floor registration request information for notifying that the passenger of the elevator car requests voice-operated destination floor registration; and wherein;

the voice destination floor registration unit, when the voice destination floor registration request information input unit has input the voice destination floor registration request information, outputs the destination floor pronouncing request voice message to the elevator car via the voice output unit, regardless of whether or not the destination floor registration signal has been input, and, when the voice destination floor registration request information input unit has not input the voice destination floor registration request information, and when the destination floor registration signal input unit does not input the destination floor registration signal after the predetermined time limit has elapsed since the passenger was detected to board the elevator car by the boarding detection unit, outputs the destination floor pronouncing request voice message to the elevator car via the voice output unit.

7. The destination floor registration device of the elevator of claim 1, wherein the voice destination floor registration unit, upon arrival at a floor for which destination floor registration has been performed based on the voice recognition process, outputs a voice message to the elevator car via the voice output unit for notifying the arrival at the destination floor.

* * * * *